United States Patent [19]

Brunelle

[11] 4,410,422

[45] Oct. 18, 1983

[54] METHOD FOR REMOVING POLYHALOGENATED HYDROCARBONS FROM NONPOLAR ORGANIC SOLVENT SOLUTIONS

[75] Inventor: Daniel J. Brunelle, Scotia, N.Y.

[73] Assignee: General Electric Company, Schenectady, N.Y.

[21] Appl. No.: 314,163

[22] Filed: Oct. 23, 1981

[51] Int. Cl.[3] ..... C10G 29/04

[52] U.S. Cl. ..... 208/262; 570/204

[58] Field of Search ..... 208/262; 570/204

[56] References Cited

U.S. PATENT DOCUMENTS 4,337,368 6/1982 Putlewski et al. ..... 570/204

FOREIGN PATENT DOCUMENTS 564683 10/1958 Canada ..... 208/262

OTHER PUBLICATIONS

Chemical Abstracts, vol. 81, 1974, 135262e.

Chemical Abstracts, vol. 82, 1975, 139620p.

Reid, E., Organic Chemistry of Bivalent Sulfur, vol. 1, Chemical Publishing Co., Inc., New York, 1958, pp. 25–27, 124–125.

A Convenient Synthesis of Aromatic Thiols from Unactivated Aryl Halides, L. Testaferri, M. Tingoli, and M. Tiecco, Tetrahedron Letters, vol. 21, pp. 3099–3100, (1980).

"Synthesis of Methylthio- and Methylsulfonyl-Polychlorobiphenyls Via Nucleophilic Aromatic Substitution of Certain Types of Polychlorobiphenyls", Bergman et al., Chemosphere No. 12, pp. 949–956 Pergamon Press Ltd., (1978) Great Britain.

"Nucleophilic Aromatic Substitution Reactions of Unactivated Aryl Halides with Thiolate Ions in Hexamethylphosphoramide", Cogolli et al., J. Org. Chem., vol. 44, No. 15, pp. 2642–2646, (1979).

"Reactions of Polychlorobenzenes with Alkanethiol Anions in HMPA, A Simple, High-Yield Synthesis of Poly(alkylthio)benzenes", Testaferri et al., J. Org. Chem., 45, pp. 4376–4380, (1980).

Hutzinger et al., The Chemistry of PCB's, CRC Press, Inc., Boca Raton, Fla.

Synthesis of Thioethers, Amide Solvent-Promoted Nucleophilic Displacement of Halide by Thiolate Ion, Campbell, Journal of Organic Chemistry, vol. 29, pp. 1830–1833 (1964).

Chemistry of the Thiol Group, S. Patia, Interscience Publishers (1974).

*Primary Examiner*—Delbert E. Gantz

*Assistant Examiner*—Cynthia A. Prezlock

*Attorney, Agent, or Firm*—William H. Pittman; James C. Davis, Jr.; James Magee, Jr.

[57] ABSTRACT

A method is provided for reducing the level of polychlorinated aromatic hydrocarbons, "PCB's", while dissolved in an organic solvent, for example, transformer oil. Removal of polychlorinated aromatic hydrocarbon from the contaminated organic solvent can be accomplished by treating the contaminated solution with a mixture of alkali mercaptide in the presence of a phase transfer catalyst.

5 Claims, No Drawings

METHOD FOR REMOVING POLYHALOGENATED HYDROCARBONS FROM NONPOLAR ORGANIC SOLVENT SOLUTIONS

CROSS REFERENCE TO RELATED APPLICATIONS

Reference is made to copending application John F. Brown, Jr., et al, Ser. No. 212,387, for "Method for Removing Polychlorinated Biphenyls from Transformer Oil," filed Dec. 3, 1980 and my copending applications Ser. No. 269,121, filed June 1, 1981 now U.S. Pat. No. 4,351,718, for "Method for Removing Polyhalogenated Hydrocarbons from Nonpolar Organic Solvent Solution", and Ser. No. 305,760 filed Sept. 25, 1981 now U.S. Pat. 4,353,793, for "Method for Removing PCB's". All of the aforementioned applications are assigned to the same assignee as the present invention.

BACKGROUND OF THE INVENTION

Polychlorinated biphenyls, or "PCB's" were long used as dielectric fluids in electrical equipment because these materials have excellent heat stability, are nonflammable in nature, have low volatility and a good viscosity characteristic at operation temperatures. Because of their environmental persistance, however, continued manufacture, import, or use in the United States was banned under the Toxic Substances Control Act of 1976, and the U.S. Environmental Protection Agency was directed to promulgate rules and regulations for their removal from the economy.

As of July 1, 1979, EPA regulations defined as "PCB-contaminated" any material containing more than 50 ppm of a mono-, di-, or polychlorinated biphenyl. The regulations permit disposal of PCB-contaminated materials by either incineration in an approved manner or in an approved landfill, but such procedures have rarely proven acceptable to community neighbors. Since considerable fractions of the transformer oils, e.g., refined asphaltic-base mineral oil, or heat exchange oils, e.g., hydrogenated terphenyls, now in service are PCB-contaminated, the problem of disposing of PCB-contaminated hydrocarbon oils in an effective manner presents a serious challenge. As used hereinafter, the term "transformer oil" signifies a mineral insulating oil of petroleum origin for use as an insulating and cooling media in electrical apparatus, for example, transformers, capacitors, underground cables, etc.

Various techniques for meeting this challenge have been proposed. One method is shown by D. K. Parker et al, Plant Engineering, Aug. 21, 1980, Pages 133–134. The method of Parker et al is based on the formation of a solution of an organo-sodium reagent, such as sodium naphthalenide, in a carrier solvent, for example, tetrahydrofuran, which is then added to the contaminated oil. The Parker et al process requires a multistep procedure involving first the formation of organo-sodium reagent, next the incorporation of such organo-sodium compound into the PCB-contaminated oil followed by at least 2 more hours for the reaction to be complete, followed by a water quench and distillation and purification steps to recycle the tetrahydrofuran. Another procedure, somewhat similar to the Parker et al process, is described by Smith et al, University of Waterloo, based on the thesis of James G. Smith and G. L. Bubbar, "The Chemical Destruction of Polychlorinated Biphenyls by Sodium Naphthalenide". Again, a length, multistep procedure is necessary before effective destruction of the PCB is achieved. A further procedure is shown by Hiraoka et al, Japan Kokai No. 74 822,570, Chem. Abstracts 8988831K, Vol. 82, 1975, which describes the destruction of polychlorinated biphenyls utilizing a sodium dispersion in kerosene, but requires a 6 hour heating period at 120° C.

Recently, Lewis L. Pytlewski et al, demonstrated that PCB's, as well as representative halogenated pesticides were found to be rapidly and completely decomposed by the use of molten sodium metal dispersed in polyethyleneglycol. The Pytlewski et al technique is shown in the reaction of PCB's with sodium, oxygen, and polyethyleneglycols, Chemistry and Biosciences Lab, Franklyn Research Center, Philadelphia, PA 19103. However, the use of metallic sodium metal requires the special handling and trace amounts of water must be eliminated to minimize dangerous side reactions.

In my copending application Ser. No. 269,121, filed June 1, 1981, now U.S. Pat. No. 4,351,718, I found that alkali metal hydroxides, for example, potassium hydroxide, could be used with polyethyleneglycols in an effective manner to completely eliminate or substantially reduce polyhalogenated aromatic hydrocarbon in substantially inert organic solvent. Similarly, in the aforementioned U.S. Pat. No. 4,353,793, I found improved results were achieved with monocapped polyalkyleneglycol ethers in combination with alkali metal hydroxide to effect PCB removal from contaminated organic solvents.

STATEMENT OF THE INVENTION

The present invention is based on the discovery that alkali mercaptides, for example, potassium dodecylmercaptide, are also effective for removal of trace amounts of PCB contaminants in transformer oil or non-polar organic solvents if used in combination with a phase transfer catalyst.

There is provided by the present invention a method of treating a PCB-contaminated solution of a substantially inert non-polar organic solvent having a concentration of polyhalogenated aromatic hydrocarbon at up to 1% by weight to reduce the polyhalogenated aromatic hydrocarbon concentration to less than 50 ppm, which comprises agitating at a temperature of 65° C. to 200° C. for a time which is at least sufficient to effect the minimum aforedescribed reduction in concentration of the polyhalogenated aromatic hydrocarbon, a mixture which comprises, by weight, (A) up to 1% of polyhalogenated aromatic hydrocarbon, (B) about 0.1 to 10% of RSH, where R is a $C_{(2-20)}$ hydrocarbon radical, (C) about 0.1 to 10% of alkali metal hydroxide, (D) about 0.1 to about 20% of a phase transfer catalyst, and (E) about 80 to 99.7% of substantially inert non-polar organic solvent, where the sum of (A)+(B)+(C)+(D)+(E) is equal to 100%.

Alkali mercaptides which can be used in the practice of the invention can be made in situ by effecting contact between alkali metal hydroxide and a $C_{(2-20)}$ thiol. Suitable thiols are shown in Thiols, Vol. 20, pp. 205–218 of the Kirk-Othmer Encyclopedia of Chemical Technology, 2nd Ed., 1969, John Wiley ' Sons, Inc., New York. For example, $C_{(2-20)}$ alkyl or $C_{(6-13)}$ aryl thiols can be used. Thiols such as n-heptyl, n-octyl, n-dodecyl are preferred.

Preferably, there can be used 1 to 2% by weight of the phase transfer catalyst, based on the weight of the PCB contaminated nonpolar hydrocarbo solvent. Suitable phase transfer catalysts which can be used in the practice of the invention are crown ethers, polyethylene glycols and phosphonium salts as described, for example, by C. M. Starks, JACS, 93 195 (1971); 18-crown-6 described by E. V. Dehmlow/S. S. Dehmlow, "Phase Transfer Catalysis", Verlag. Chemie, Pub. (1980); dibenzo-18-crown-6, dicyclohexyl-18-crown-6 described by W. P. Weber, G. W. Gokel, "Phase Transfer Catalysis in Organic Synthesis", Springer-Verlag (1977); polyethyleneglycol MW200-2000,pentaethyleneglycol described by Tetrahedron Letters, 3543, (1979), hexaethyleneglycol, Vogtle & Weber, Aug. Chem. IEE, 18, 753–766 (1979).

Some of the preferred phase transfer catalysts are tetrabutylphosphonium bromide, tetraoctylphosphonium bromide, tricyclobutyl n-dodecylphosphonium bromide, triisopropl n-dodecylphosphonium bromide.

Alkali metal hydroxides which can be used in the practice of the present invention are, for example, sodium hydroxide, potassium hydroxide, cesium hydroxide, etc.

In the practice of the present invention, a mixture of thiol, alkali metal hydroxide, and phase transfer catalyst is utilized in combination with PCB contaminated nonpolar organic solvent. The resulting mixture is thereafter agitated until the level of the PCB contaminant is reduced to less than 50 ppm.

Temperatures in the range of between 25° C. to 75° C. are preferred, whereas a temperature in the range of between 25° C to 150° C. can be used.

It has been found that a proportion of 1 to 10 equivalents of alkali metal of the alkali metal hydroxide, per —SH of the thiol can be used, while substantially an equal stoichiometric equivalent of —SH to M, where M is an alkali metal, is preferred.

It also has been found that effective results can be achieved if at least one equivalent of alkali metal per —SH of the thiol is used for removing one equivalent of halogen atom from the PCB. Higher amounts are preferably used to facilitate PCB removal.

The alkali mercaptide can be preformed, or the aforementioned ingredients can be added separately within the aforementioned limits to the PCB contaminated, nonpolar organic solvent. Experience has shown that agitation of the resulting mixture, such as stirring or shaking, is necessary to achieve effective results.

In order to effectively monitor the reduction or removal of PCB or polyhalogenated aromatic hydrocarbon contamination, such as polychlorinated biphenyl contamination in the non-polar or substantially inert organic solvent, a vapor phase chromatograph, for example, Model No. 3700, of the Varian Instrument Company, can be used in accordance with the following procedure:

An internal standard, for example, n-docosane can be added to the initial reaction mixture. The standard is then integrated relative to the PCB envelope to determine ppm concentration upon VPC analysis.

In order that those skilled in the art will be better able to practice the present invention, the following examples are given by way of illustration and not by way of limitation. All parts are by weight unless otherwise indicated.

EXAMPLE 1

There were added 1.445 part of potassium hydroxide and 2.31 parts of polyethylene glycol having an average molecular weight of 400 with stirring to a mixture of 100 parts of a blend of 20 parts of toluene and 70 parts by heptane by volume containing 5,000 ppm of Arochlor 1260 and about 0.1 parts of n-docosane as an internal standard.

There was added to the above mixture 2.34 parts of dodecyl mercaptan while the mixture was stirring at a temperature of 75° C. An aliquot of the mixture was removed after 1 hour and analyzed by vapor phase chromatography. A second aliquot of the mixture was analyzed by VPC after 2 hours.

The above procedure was repeated, except that there was used phenyl mercaptan and benzyl mercaptan. The following results were obtained:

TABLE I

| Thiol (parts) | Time (hrs) | Temp. °C. | PCB Remaining (ppm) |
|---|---|---|---|
| $C_{12}H_{25}SH$ (2.34) | 1 | 75 | 40 |
| $C_{12}H_{25}SH$ (2.34) | 2 | 75 | none |
| $C_6H_5SH$ (1.28) | 1 | 75 | 4700 |
| $C_6H_5SH$ (1.28) | 2 | 75 | 4570 |
| $C_6H_5SH$ (1.28) | 5 | 100 | 2830 |
| $C_6H_5SH$ (1.28) | 20 | 100 | 500 |
| $C_6H_5CH_2SH$ (1.44) | 1 | 75 | 2707 |
| $C_6H_5CH_2SH$ (1.44) | 2 | 75 | 2140 |
| $C_6H_5CH_2SH$ (1.44) | 5 | 100 | 382 |
| $C_6H_5CH_2SH$ (1.44) | 20 | 100 | none |

EXAMPLE 2

There were added 1.85 part of potassium hydroxide and 2.45 parts of tricyclobutyl n-dodecylphosphonium bromide to a mixture of 100 parts of a toulene/heptane solution containing 20% of toluene by volume and 10,000 ppm of Arochlor 1260 utilizing n-docosane as an internal standard.

In accordance with the procedure of Example 1, there was added to the above mixture at a temperature of about 75° C., 2.811 parts of dodecyl mercaptan. Aliquots of the resulting mixture were then removed after 1 and 2 hours and analyzed for remaining PCB utilizing vapor phase cohromatography. The same procedure was repeated employing phenyl mercaptan and benzyl mercaptan. The following results were obtained:

TABLE II

| Thiol (parts) | Time (hrs) | Temp. °C. | PCB Remaining (ppm) |
|---|---|---|---|
| $C_{12}H_{25}SH$ (2.811) | 1 | 75 | 14 |
| $C_{12}H_{25}SH$ (2.811) | 2 | 75 | none |
| $C_6H_5SH$ (1.54) | 1 | 75 | 4490 |
| $C_6H_5SH$ (1.54) | 2 | 75 | 2770 |
| $C_6H_5SH$ (1.54) | 5 | 75 | 2070 |
| $C_6H_5SH$ (1.54) | 8 | 100 | 575 |
| $C_6H_5SH$ (1.54) | 20 | 100 | 295 |
| $C_6H_5CH_2SH$ (1.725) | 1 | 75 | 715 |
| $C_6H_5CH_2SH$ (1.725) | 2 | 75 | 57 |
| $C_6H_5CH_2SH$ (1.725) | 5 | 75 | 23 |
| $C_6H_5CH_2SH$ (1.725) | 8 | 100 | none |

EXAMPLE 3

In accordance with the procedure of Example 1, various amounts of potassium hydroxide, and certain phase transfer catalysts were added to 100 parts of transformer oil containing 650 ppm of Arochlor 1260. There were added with stirring to the resulting mixture a variety of mercaptans, sodium sulfide, sodium mercaptide and ethylenethioglycol. The various mixtures were then analyzed by vapor phase chromatography utilizing an electron capture detector to determine the effects of the various sulfur compounds on the elimination of PCB from the transformer oil. The following results were obtained:

TABLE III

| Mercaptan (parts) | Base (parts) | ptc (parts) | Temp | Time (hr) | ppm PCB |
|---|---|---|---|---|---|
| $C_7H_{15}SH$ (3) | KOH (.5) | cyclohexyl$_3$P—$C_{12}H_{25}$ (.15) | RT | 4/16 | 431/430 |
| $C_7H_{15}SH$ (3) | KOH (.5) | cyclohexyl$_3$P—$C_{12}H_{25}$ (.15) | 50 | 4/16 | 334/321 |
| $C_7H_{15}SH$ (3) | KOH (.5) | cyclohexyl$_3$P—$C_{12}H_{25}$ (.15) | 75 | 4/16 | 235/180 |
| $C_7H_{15}SH$ (3) | KOH (.6) | PEG 300 (5) | 75 | 24 | 7 |
| $C_7H_{15}SH$ (3) | KOH (.6) | PEG 300 (10) | 75 | 24 | 2 |
| $C_7H_{15}SH$ (3) | KOH (.6) | PEG 300 (10) | 75 | 24 | 0 |
| $C_7H_{15}SH$ (3) | KOH (1) | PEG 300 (5) | 75 | 16 | 2 |
| $C_7H_{15}SH$ (3) | KOH (1) | PEG 300 (1) | 75 | 16 | 7 |
| $C_7H_{15}SH$ (3) | KOH (1) | PEG 300 (0.5) | 75 | 16 | 100 |
| $C_7H_{15}SH$ (3) | KOH (1) | PEG 300 (1) | 75 | 1/2 | 130/96 |
| | | | | 4/8 | 75/31 |
| $C_{12}H_{25}SH$ (3) | KOH (1) | PEG 300 (2) | 100 | 2/24 | 125/0 |
| $C_{12}H_{25}SH$ (3) | KOH (1) | PEG 300 (5) | 100 | 2/24 | 27/0 |
| $C_7H_{15}SH$ (3.5) | KOH (1) | $HO(C_2H_4OC_2H_4)_2O$ (3) | 100 | 2/8 | 242/132 |
| 1,6-dithiol (1.8) | KOH (1) | PEG 300 (5) | 100 | 2/8 | 103/4 |
| $Na_2S$ (5) | KOH (1) | PEG 300 (5) | 100 | 2/8 | 347/167 |
| NaSH (5) | None | PEG 300 (5) | 100 | 2/8 | 253/133 |
| $HOCH_2CH_2SH$ (5) | None | PEG 300 (5) | 100 | 2/8 | 394/250 |

The above results show that alkali mercaptides are effective reagents for the elimination of PCB contaminants in various nonpolar organic solvents including transformer oil. The employment of a suitable phase transfer catalyst is also shown to be effective to facilitate the reaction between the PCB and the mercaptide which is substantially insoluble in the nonpolar organic solvent.

Although the above examples are directed to only a few of the vary many variables which can be present in the practice of the method of the present invention, it should be understood that the present invention is directed to a much broader variety of materials, such as the thiols, alkali metal hydroxides and the phase transfer catalysts shown in the description preceding these examples.

What I claim as new and desire to secure by Letters Patent of the United States is:

1. A method of treating a PCB-contaminated solution of a substantially inert non-polar organic solvent having a concentration of polyhalogenated aromatic hydrocarbon at up to 1% by weight to reduce the polyhalogenated aromatic hydrocarbon concentration to less than 50 ppm, which comprises agitating at a temperature of 65° C. to 200° C. a mixture which comprises, by weight, (A) up to 1% of polyhalogenated aromatic hydrocarbon, (B) about 0.1 to 10% of RSH, where R is a $C_{2-20}$ hydrocarbon radical, (C) about 0.1 to 10% of alkali metal hydroxide, (D) about 0.1 to 20% of a phase transfer catalyst, and (E) about 80–99.7% of substantially inert non-polar organic solvent, where the sum of (A)+(B)+(C)+(D)+(E) is equal to 100%.

2. A method in accordance with claim 1, where R is a phenyl radical.

3. A method in accordance with claim 1, where the alkali metal hydroxide is potassium hydroxide.

4. A method in accordance with claim 1, where the polyhalogenate aromatic hydrocarbon is chlorinated biphenyl.

5. A method in accordance with claim 1, where the nonpolar organic solvent is transformer oil.

* * * * *